US005715766A

United States Patent [19]

Numanoi

[11] Patent Number: 5,715,766

[45] Date of Patent: Feb. 10, 1998

[54] PRESSURE UNIT FOR BAR TACKING SEWING MACHINE

[75] Inventor: Takao Numanoi, Kawachi-machi, Japan

[73] Assignee: The Singer Company N.V., Curaco, Netherlands

[21] Appl. No.: 586,382

[22] Filed: Jan. 16, 1996

[30] Foreign Application Priority Data

Jan. 20, 1995 [JP] Japan ..... 7-024557

[51] Int. Cl.[6] ..... D05B 29/00; D05B 3/00; D05B 21/00

[52] U.S. Cl. ..... 112/470.14; 112/114; 112/235

[58] Field of Search ..... 112/235, 470.14, 112/470.18, 470.09, 470.06, 114

[56] References Cited

U.S. PATENT DOCUMENTS 2,808,794 10/1957 Ayres ..... 112/235
3,295,484 1/1967 Boser et al. ..... 112/235 X
4,699,072 10/1987 Tsukioka ..... 112/235
5,146,859 9/1992 Conley, Jr. et al. .
5,205,231 4/1993 Sanvito et al. ..... 112/235
5,441,001 8/1995 Conley, Jr. et al. ..... 112/470.14 X

*Primary Examiner*—Paul C. Lewis
*Attorney, Agent, or Firm*—McCormick, Paulding & Huber

[57] ABSTRACT

A presser unit for a bar tacking sewing machine comprises four separate clamp feet 15, 16, 17 and 18 which conform in outer appearance to the U-shaped stitches I—I, II—II and III—III to be formed at the tip end of the waist band portions of pants and a pressing mechanism 60 for elastically press each clamp feet 15, 16, 17 and 18 against a workpiece A with a given pressure thereby to elastically press the workpiece A. As a result, it is possible to provide the presser unit for a bar tacking sewing machine which can perform sewing with improved efficiency and high quality without generating discontinuous stitches and the breakage of a needle, since the tip ends of the waist band portions of pants can be sewn in U shape continuously and easily irrespective of the longitudinal and lateral variation of thickness of the workpiece A and moreover without adjusting a pressure mechanism by applying four separate clamp feet to a portion to be sewn of the workpiece A in such a way as to fit the shape and thickness thereof.

3 Claims, 4 Drawing Sheets

PRESSURE UNIT FOR BAR TACKING SEWING MACHINE

BACKGROUND OF THE INVENTION

1. Field of the Invention

The present invention relates to a presser unit for a bar tacking sewing machine.

2. Description of the Related Art

A bar tacking sewing machine performs a variety of sewing operations such as bar tacking, buttoning etc. with a given number of stitches. Bar tacking sewing machines are often used to sew waist band portions of pants. Particularly the tip ends of the waist band portions of denim pants which requires the sewing together of a plurality of thick work pieces that have been turned inside-out. At that time, however, the portion to be subjected to sewing is uneven as a whole since it comprises thin portions and thick portions concentrated in a narrow area, the thick portions being formed by folding back the cloths sewn together.

Sewing the U-shaped portions of such waist band portions at the tip ends thereof with consistently high quality requires dexterity of hand and expertise since the workpiece which is pressed down by the presser unit varies in thickness. Accordingly, there was the likelihood of generating discontinuous stitches or needle breakage, which required that the workpiece be re-sewn or the needle exchanged. When sewing the waist band portions at the tip ends of denim pants, the work piece can be as much as ten times thicker on one side of the sewing machine than on the other.

A conventional presser unit for a sewing machine, for example, is disclosed in the Japanese Utility Model Laid-Open Publication No. 4-135274. It is a presser unit which presses from above a base cloth and a cloth put thereon upon a cloth feeder which horizontally moves in synchronization with the vertical movement of the needle so as to fix the cloths to the cloth feeder, the presser unit being characterized in comprising a cloth clamp foot which is vertically moved by a given elevating means relative to the cloth feeder and presses the cloth at the portion thereof inside that to be sewn when it is lowered, and a corner clamp foot which is moved horizontally together with the cloth feeder and vertically by a given elevating means relative to the cloth feeder so as to press the cloth at the portion adjacent to the corner thereof when it is lowered. The clamp foot has a width smaller than a space between two stitch lines to be formed along the corner of the cloth so as to press the cloth therebetween.

Moreover, the conventional presser unit for a sewing machine employs clamp feet which are connected to one another so as to substantially function as a clamp foot arranged adjacent to the portion to be sewn as close as possible for sewing therearound (cloth clamp foot) or sewing between a pair of clamp foot sets (each composed of the cloth clamp feet and the corner clamp foot). Accordingly, a problem often occurs in that it is difficult to uniformly press a workpiece in the portion thereof which largely varies in thickness or shape due to cloths overlapping therein. Particularly, it was impossible to press a workpiece which largely varies in thickness in the longitudinal direction with proper pressure for each portion of thickness.

SUMMARY OF THE INVENTION

The present invention has been made in consideration of such conventional technical problems to provide a presser unit for a bar tacking sewing machine having the following structure.

A presser unit according to a first aspect of the invention is a presser unit for a bar tacking sewing machine which lowers to press a workpiece A onto a workpiece feeding mechanism 14 at the beginning of sewing during which a needle 7 moves vertically and rises to release the workpiece A upon completion of sewing, and which is used for sewing U shaped the tip ends of the waist band portions of pants, characterized in four separate clamp feet 15, 16, 17 and 18 having an external form as a whole substantially conforming to the U-shaped stitches I—I, II—II, and III—III and a pressing mechanism 60 for elastically pressing each of the clamp feet 15, 16, 17 and 18 toward the workpiece A with a given pressure so as to elastically press the workpiece A with each of the clamp feet 15, 16, 17 and 18.

A presser unit for a bar tacking sewing machine according to a second aspect of the invention is that of the first aspect of the invention characterized in that the four separate clamp feet 15, 16, 17 and 18 are composed of two central clamp feet 15 and 16 and two side clamp feet 17 and 18, the two central members 15 and 16 elastically pressing the thick portions of the workpiece A at the tip end portions thereof and the two side clamp feet 17 and 18 respectively arranged at the outer sides of the two central clamp feet 15 and 16 close thereto elastically pressing the thin portions of the workpiece A and the four separate clamp feet 15, 16, 17 and 18 being formed to fit the workpiece A respectively in thickness and shape.

A presser unit for a bar tacking sewing machine according to a third aspect of the invention is that of the first or second aspect of the invention characterized in that the clamp feet 15, 16, 17 and 18 form two pairs arranged at left and right sides of a supporting arch member 19 symmetrically with respect thereto, the supporting arch member 19 being fixedly mounted on the workpiece feeding mechanism 14, wherein the clamp feet 15, 16, 17 and 18 are respectively attached to the tip end portions of arm members 49, 50, 51 and 52 which are swingably supported by the central portion of the supporting arch member 19, while the rear end portions of the arm members 49, 50, 51 and 52 are forced upward by elastic supporting bodies 54, 55, 56 and 57 respectively, the elastic supporting bodies 54, 55, 56 and 57 constituting the pressing mechanism 60.

A presser unit according to a fourth aspect of the invention is that of the third aspect of the invention characterized in that a clamp foot 70 is provided above the rear end portions of the arm members 49, 50, 51 and 52 to press down the same when it lowers.

According to the first aspect of the invention, a sewing machine equipped with the presser unit performs a U-shaped sewing operation on a workpiece. At the tip end of the waist band portions, a plurality of cloths are sewn together, and further they are folded inside to be subjected to sewing. As a result, the workpiece A is uneven as a whole at the portion to be sewn since the portion where the cloths sewn together are folded back is concentrated to a narrow region.

When the U shaped sewing operation is performed on the waist band portions, the clamp feet 15, 16, 17 and 18 are individually pressed against the workpiece A on the workpiece feeding mechanism 14 elastically by the pressing mechanism 60. As a result, the U shape sewing is performed continuously and with high-quality to the tip ends of the waist band portions of pants where the workpiece A pressed by the clamp feet 15, 16, 17 and 18 largely varies in thickness. Since the needle 7 passes around the clamp feet 15, 16, 17 and 18 forming a block, the workpiece A is effectively pressed down and held by the clamp feet 15, 16, 17 and 18 about the portions thereof where the stitches I—I, II—II and III—III are to be formed. When the clamp feet 15, 16, 17 and 18 are moved vertically due to the variation of thickness at the portion to be sewn, the pressing mechanism 60 operates effectively.

According to the second aspect of the invention, when the clamp feet 15, 16, 17 and 18 lower to press the workpiece A, two central clamp feet 15 and 16 elastically press down the thick portions of the workpiece A on the workpiece feeding mechanism 14 at the tip end portions thereof, while two side clamp feet 17 and 18 elastically press down the thin portions of the workpiece A on the workpiece feeding mechanism 14. The side clamp feet 17 and 18 are respectively disposed at the outer sides of the central clamp feet 15 and 16 close thereto to effectively press down the workpiece A. Since the needle 7 passes around the clamp feet 15, 16, 17 and 18 forming a block, the side clamp feet 17 and 18 and the tip end portions of the central clamp feet 15 and 16 and effectively press down and hold the workpiece A about the portions where the stitches I—I, II—II and III—III are to be formed.

According to the third aspect of the invention, the tip end portions of the clamp feet 15, 16, 17 and 18 are forced downward by the elastic supporting bodies 54, 55, 56 and 57 which form the pressing mechanism 60 respectively to be elastically pressed against the workpiece A on the workpiece feeding mechanism 14. The clamp feet 15, 16, 17 and 18 independently swing about the central portion of the supporting arch member 19 fulcruming the same, while being elastically supported by the elastic supporting bodies 54, 55, 56 and 57 respectively, so as to meet the difference of thickness of the workpiece A. When the clamp feet 15, 16, 17 and 18 are moved vertically due to the variation of thickness of the portions to be sewn, the elastic supporting bodies 54, 55, 56 and 57 operate to control the clamp feet 15, 16, 17 and 18 respectively.

According to the fourth aspect of the invention, it is possible to separate the clamp feet 15, 16, 17 and 18 from the workpiece A by lowering the clamp foot 70 to swing the arm members 49, 50, 51 and 52 against the resilience of the elastic supporting bodies 54, 55, 56 and 57. It is also possible to press the clamp feet 15, 16, 17 and 18 onto the workpiece A by raising the clamp foot 70 to allow the arm members 49, 50, 51 and 52 to swing by way of the resilience of the elastic supporting bodies 54, 55, 56 and 57.

DESCRIPTION OF THE PREFERRED EMBODIMENT

An embodiment of the present invention will be described hereinafter with reference to the drawings.

Figure 5:
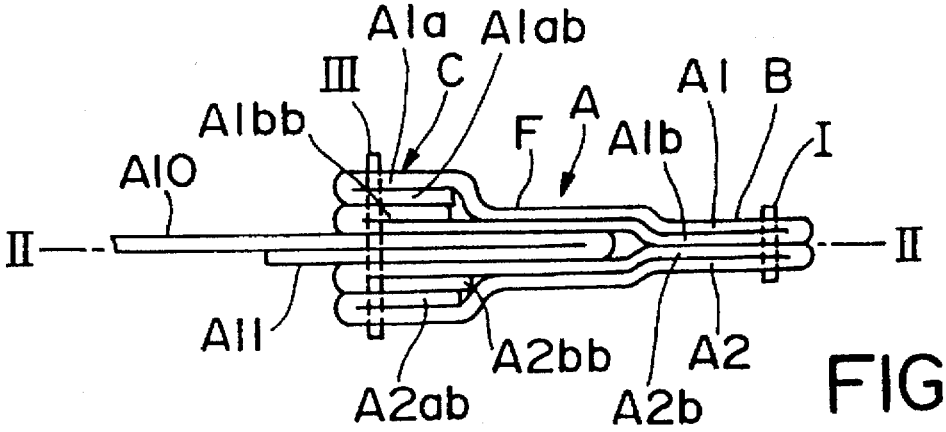
FIG. 5 is a cross-sectional view of a workpiece cut along stitches II—II.
Figure 6:
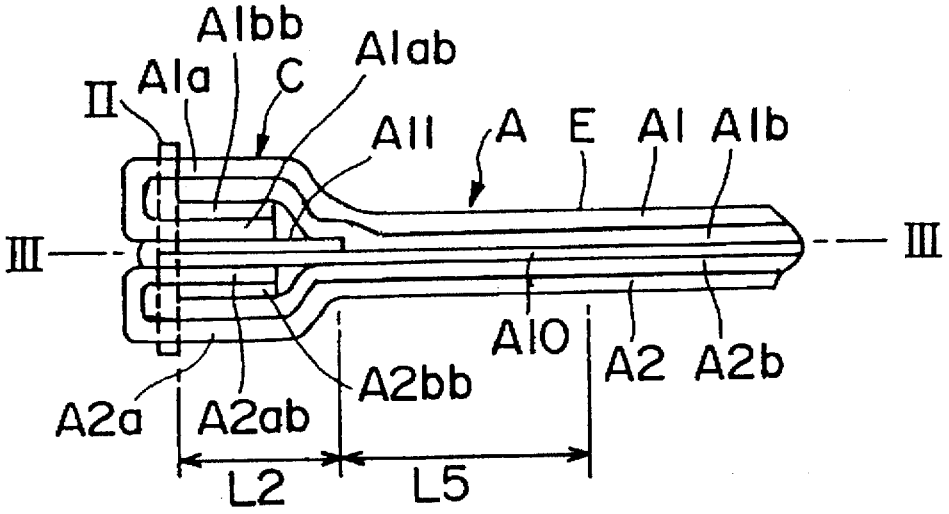
FIG. 6 is a cross-sectional view of a workpiece cut along stitches III—III.
Figure 7:
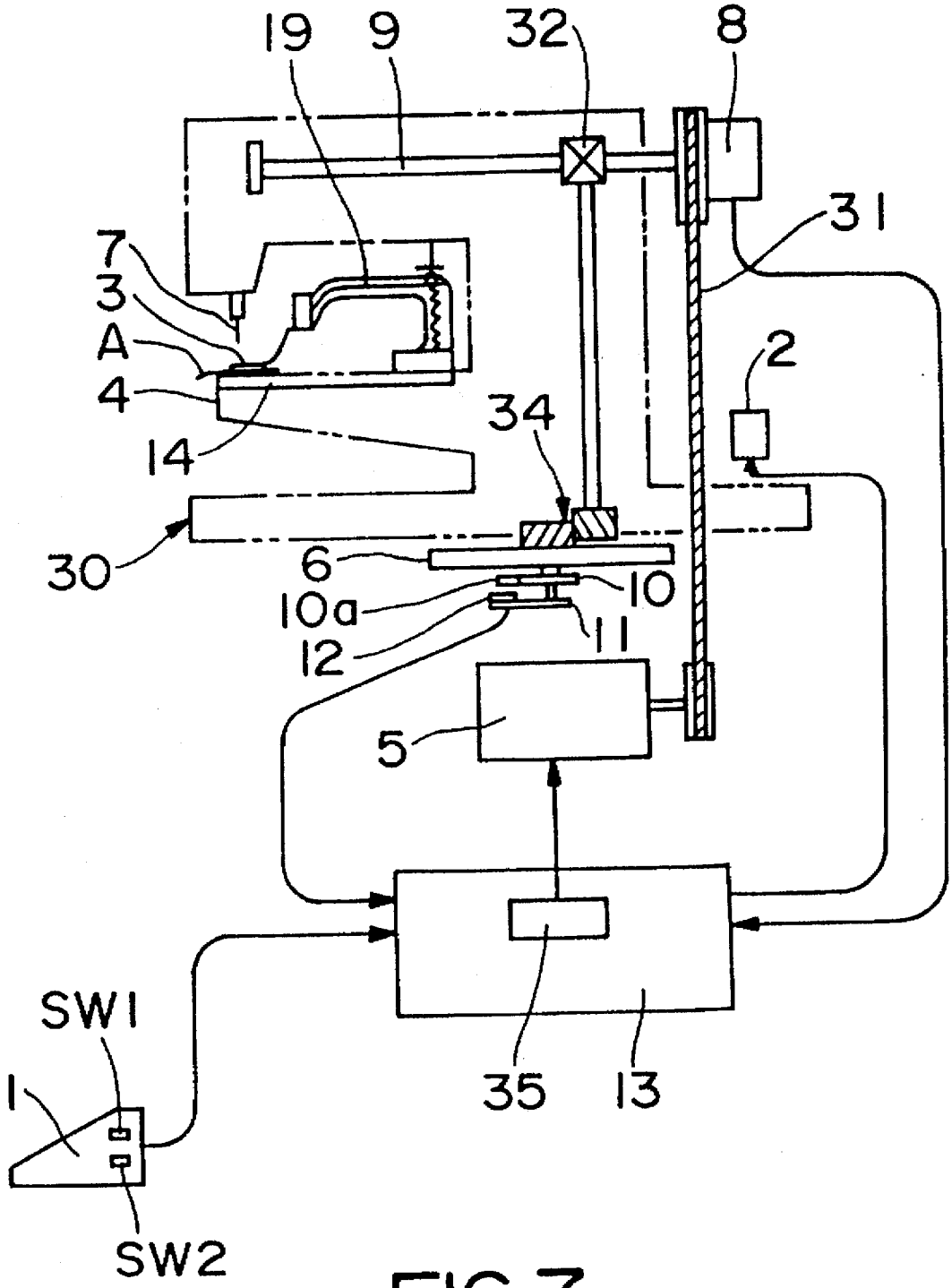
FIG. 7 is a schematic view of a bar tacking sewing machine in FIG. 1.

FIGS. 1 to 7 show a bar tacking sewing machine according to an embodiment of the present invention. At first, an outline of a bar tacking sewing machine will be described. In FIG. 7, denoted at 30 is a sewing machine body, and a needle position detector 8 including a tachometer generator (generator-type speedometer) is provided at one end portion of an upper shaft 9 which is rotatably supported by the sewing machine body 30. The needle position detector 8 detects the rotating angle of the upper shaft 9 to detect the position of the needle 7 moved by the upper shaft 9 and successively outputs signals representing a needle upper position, a needle lower position, and further the number of stitches.

In FIG. 7, denoted at 13 is a control box containing a microcomputer therein, to which a detection signal of a depressed position corresponding to the depressed amount of a foot switch 1, a detection signal supplied by the needle position detector 8, and a speed switching and a thread cutting signals supplied by a stop sensor 12 that serves as a first and second position detection means. The control box 13 outputs an electric signal for actuating and controlling a presser cylinder unit 2 etc. or controls the rotating speed of a driving motor 5 based on these signals. The driving motor 5 rotates the upper shaft 9 by way of a belt transmission 31.

Before a sewing operation, the presser cylinder unit 2 is extended to raise a presser 3 by way of a link mechanism, not shown. When the foot switch 1 is depressed as far as the first stage at this state, a first switch SW1 is turned OFF and the presser cylinder unit 2 is contracted to lower the presser 3 based on the detection signal of the OFF state of the first switch SW1, so as to press the workpiece A on the workpiece feeding mechanism 14 provided on a sewing machine bed 4.

When the foot switch 1 is further depressed as far as the second stage, a second switch SW2 is turned ON and the driving motor 5 starts low-speed rotation based on the detection signal of the ON state of the second switch SW2. As a result, the upper shaft 9 is rotated by way of the belt 31 for driving the sewing machine to perform sewing operation at a low speed while driving the workpiece feeding mechanism 14 incorporated in the sewing machine bed 4 in accordance with a feeding pattern of a feed cam which is rotated by the upper shaft 9 by way of gears 32 and 34. At the starting time of the low-speed rotation of the driving motor 5, the needle 7 is at the upper (stop) position, and thereafter the needle position detector 8 outputs the needle upper position signal and the needle lower position signal alternately and at comparatively large time intervals. The driving motor 5 is switched to a high-speed rotation after sewing a given number of stitches upon reception of the signal from the needle position detector 8 so that the upper shaft 9 and consequently the sewing machine is switched to a high-speed rotation. The first switch SW1 is returned to ON state concurrently.

Figure 1:
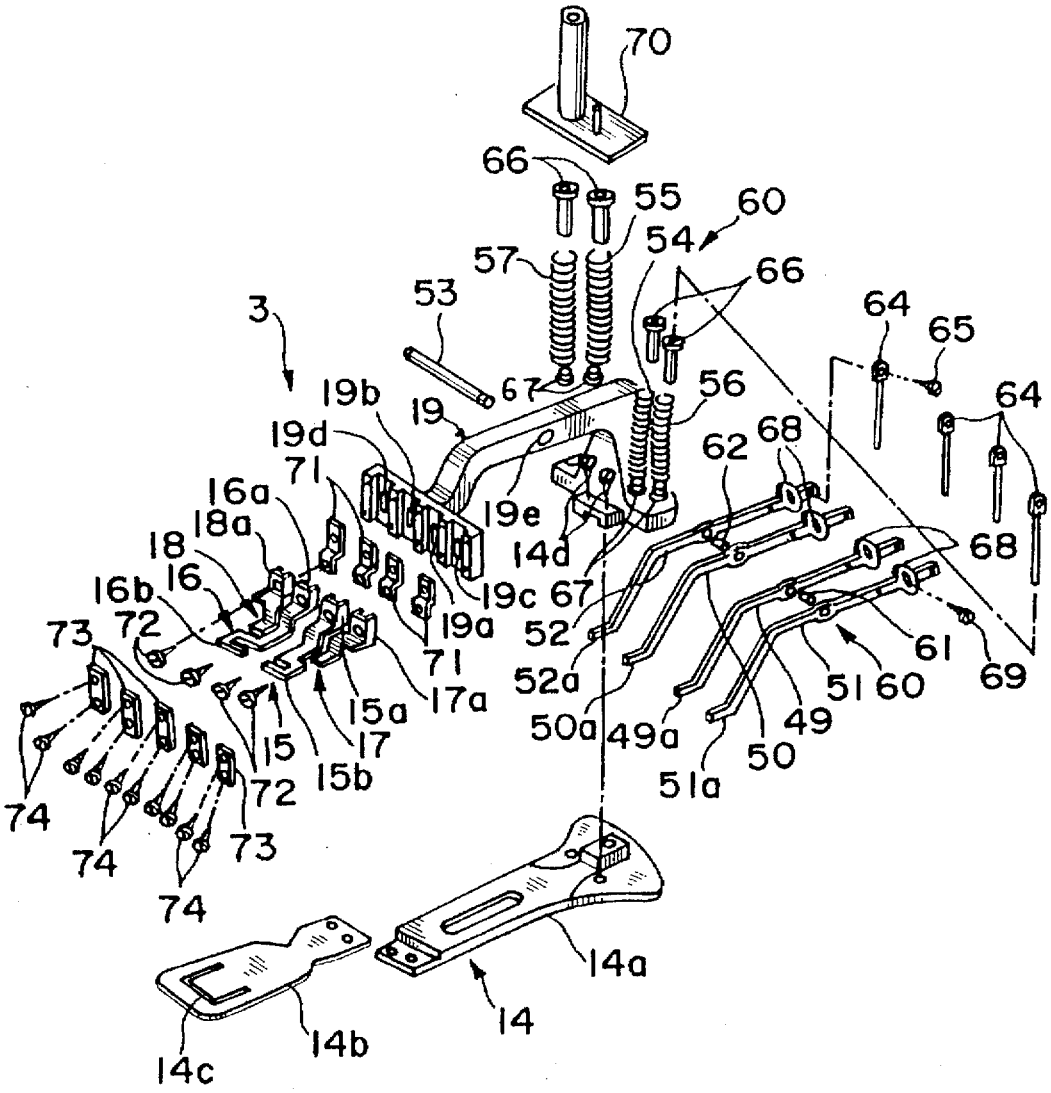
FIG. 1 is a partially omitted perspective view of a presser unit for a bar tacking sewing machine according to a first embodiment of the present invention.
Figure 2:
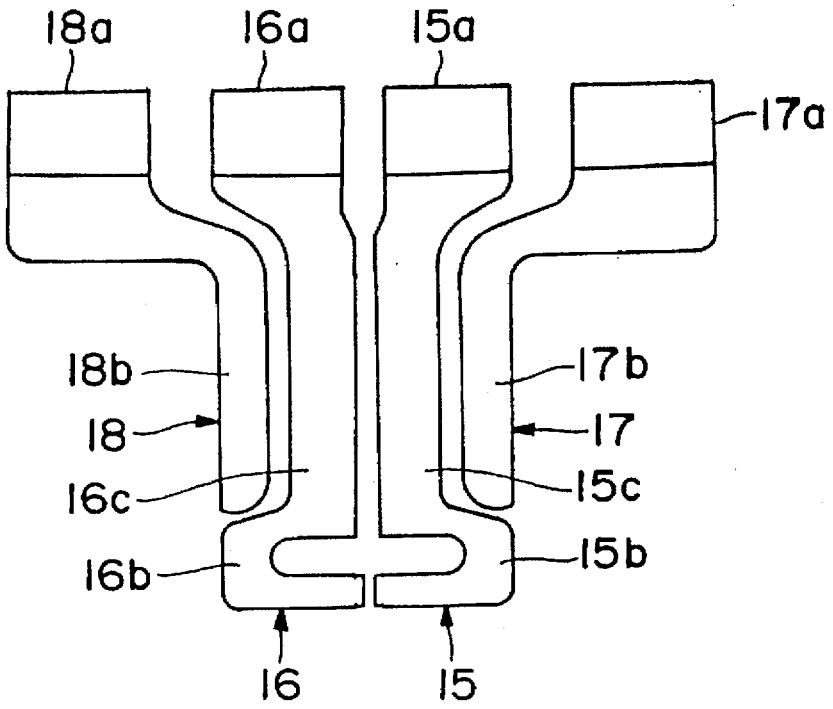
FIG. 2 is a plan view of clamp feet in FIG. 1.

The workpiece feeding mechanism 14 comprises a feeder plate carrier member 14*a* to which the lower surface of the rear end portion of the supporting arch member 19, described later, is fixed by a pair of screws 14*d* and a feeder plate 14b which is fixed to the front side of the feeder plate carrier member 14*a* as shown in FIG. 1, and a workpiece A placed on the feeder plate carrier member 14*a* and the feeder plate 14*b* moves forward and backward, or tight and left on a horizontal plane together with the feeder plate carrier member 14*a*, the feeder plate 14*b* and a presser 3, described later. A U-shaped cut-out portion 14*c* formed in the feeder plate 14*b* is a needle groove through which the needle 7 passes.

When a sewing operation is going to end, a tongue 10*a* that is the detecting portion of a detecting member 10 turns toward the stop sensor 12 on a bracket 11. The tongue 10*a* approaches and conforms to the stop sensor 12, when the same outputs a detection signal (speed switching signal). Based on the signal, an upper shaft rotating speed control unit 35 in the control box 13 supplies a signal indicating a low-speed rotation to the driving motor 5, so that the sewing machine is switched to a low-speed rotation and stops after sewing a given number of stitches with the needle 7 positioned at the upper position. In this way, the workpiece A is sewn while being moved forward and backward or left and right by the workpiece feeding mechanism 14 in synchronism with the vertical movement of the needle 7 so as to subject pants that are the workpiece A, e.g., the waist band portions of denim pants to a U-shape sewing. At the last stitch of a cycle of sewing operation, thread cutting is performed.

The presser 3 will be described hereinafter.

The presser 3 comprises a supporting arch member 19 which is fixedly mounted on the feeder plate carrier member 14*a* on the sewing machine bed 4 at one end portion thereof, four independent clamp feet 15, 16, 17 and 18 illustrated in FIG. 1 and the pressing mechanism 60. The pressing mechanism 60 comprises the elastic supporting bodies 54, 55, 56 and 57 each made of a coil spring which form two pairs arranged at both sides of the supporting arch member 19 symmetrically with respect thereto as shown in FIG. 1, the arm members 49, 50, 51 and 52 being spaced from each other in the two pairs thereof by way of short-cylindrical spacers 61 and 62 respectively, while being swingably supported by a pin 53 inserted through a through hole 19*e* formed at the central portion of the supporting arch member 19. A pair of arm members 49 and 51 of the arm members 49, 50, 51 and 52 are arranged at one side of the supporting arch member 19 (fight side in the figure), while the other pair of arm members 50 and 52 thereof is arranged on the other side of the supporting arch member 19 (left side in the figure).

Guide shafts 64 each attached to each of the rear end portions of the arm members 49, 50, 51 and 52 by way of a hinge screw 65 and inserted into each upper end portion of the elastic supporting bodies 54, 55, 56 and 57 to be retained thereby are further inserted into upper collars 66 respectively, while the lower end portions of the elastic supporting bodies 54, 55, 56 and 57 are respectively supported by the supporting arch member 19 by way of lower collars 67. As a result, the upper and lower end portions of the elastic supporting bodies 54, 55, 56 and 57 are properly positioned respectively. Each of the adjusting members 68 is pivotally connected to each adjacent adjusting member by a pin 61, each adjusting member 68 being able to be fixed at a position relative to each of the arm members 49, 50, 51 and 52 by fastening the former to the latter by a set screw 69.

The clamp foot 70 is disposed above the rear end portions of the arm members 49, 50, 51 and 52 corresponding to the adjusting members 68, so as to press down each adjusting member 68 and the rear end portions of the arm members 49, 50, 51 and 52 together against the resilience of the elastic supporting bodies 54, 55, 56 and 57 by actuating the presser cylinder unit 2 to lower the clamp foot 70 by way of a link mechanism, not shown.

Moreover, the front end portions 49*a*, 50*a*, 51*a* and 52*a* of the arm members 49, 50, 51 and 52 engage the hole portions of presser shanks 71 passing through vertically long holes 19*a*, 19*b*, 19*c* and 19*d* formed in the concave portions of the front end of the supporting arch member 19 respectively.

Each of the base portions 15*a*, 16*a*, 17*a* and 18*a* of the clamp feet 15, 16, 17 and 18 is fixed to the lower end portion of each presser shank 71 by way of a set screw 72. Furthermore, each presser supporting member 73 is attached to the front end surface of the supporting arch member 19 by way of a plurality of set screws 74 so that each presser shank 71 and consequently each of the clamp feet 15, 16, 17 and 18 is guided in vertical movement by each concave portion at the front end of the supporting arch member 19 and each presser supporting member 73.

When the presser cylinder unit 2 is actuated to raise the clamp foot 70 by way of a link mechanism, not shown, the clamp feet 15, 16, 17 and 18 are elastically pressed on the feeder plate 14*b* of the workpiece feeding mechanism 14 by the resilience of the elastic supporting bodies 54, 55, 56 and 57 respectively, and when the clamp foot 70 is lowered, the clamp feet 15 15, 16, 17 and 18 are separated from the feeder plate 14*b*.

The clamp feet 15, 16, 17 and 18 are composed of two clamp feet and 16 which are connected to arm members 49 and 50 respectively and are positioned at the central portion and two clamp feet 17 and 18 which are connected to arm members 51 and 52 respectively and are positioned at both sides of the clamp feet 15 and 16. Two central clamp feet 15 and 16 comprise tip end presser portions 15*b* and 16*b* each having an outer appearance of U shape at the tip end portion thereof as shown in detail in FIG. 2, the tip end presser portions 15*b* and 16*b* pressing the workpiece A on the workpiece feeding mechanism 14 cooperating with the side clamp feet 17 and 18. The tip end presser portions 15*b* and 16*b* shown in the figure each being U-shaped to reduce weight are connected to the base portions 15*a* and 16*a* by way of belt-shaped connecting portions 15*c* and 16*c* respectively. The longitudinal lengths of the tip end presser portions 15*b* and 16*b* substantially conform to lengths $L_1$ and $L_2$ between the rear end portions of thick portions B and C of the workpiece A, described later, and the stitches II—II at the front end of the U shape at the tip end of the waist band portions of pants shown in FIG. 3.

Figure 4:
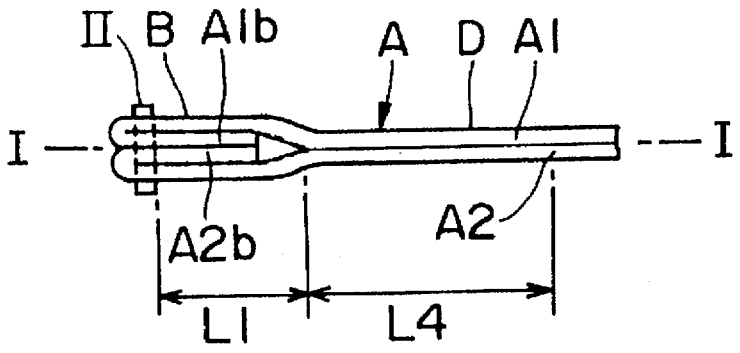
FIG. 4 is a cross-sectional view of a workpiece cut along stitches I—I.

Two side clamp feet 17 and 18 have functions to press down thin portions D and E at the rear end of the workpiece A instead of the thick portions B and C thereof, and the longitudinal lengths of the side presser portions 17*b* and 18*b* which press down the workpiece A substantially conform to lengths $L_4$ and $L_5$ which are obtained by subtracting those of the thick portions B and C of the workpiece A along the stitches I—I, III—III from those of the stitches I—I, III—III in the longitudinal direction (illustrated in FIGS. 4 and 6). Whereas a block of tip end presser portions 15*b* and 16*b* and side presser portions 17*b* and 18*b* substantially conform in outer appearance to the U-shaped stitches I—I, II—II and III—III.

The function of the presser 3 according to the above embodiment will be described hereinafter.

Figure 3:
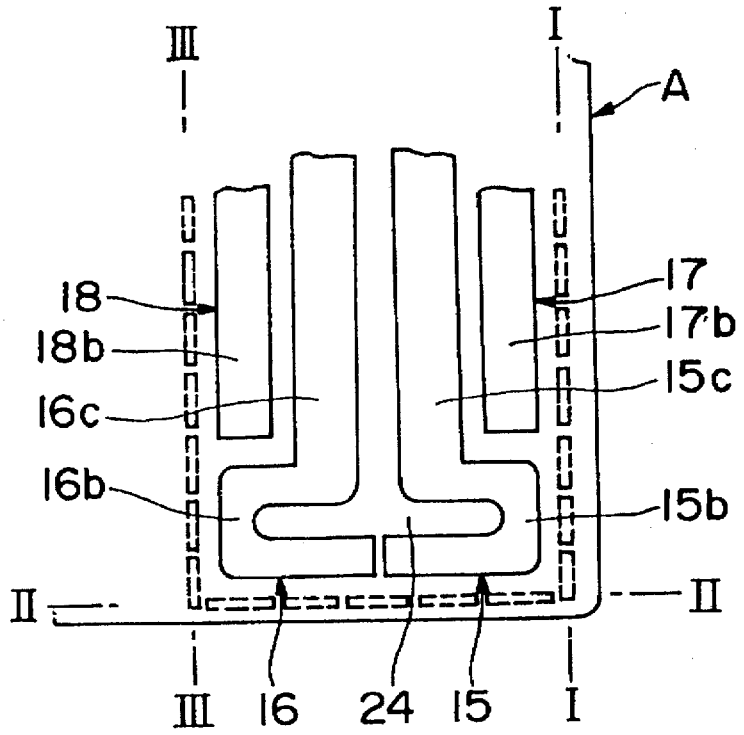
FIG. 3 is a view for explaining the operation of the clamp feet in FIG. 1.

A bar tacking sewing machine equipped with the presser 3 performs U-shaped sewing to the workpiece A, in concrete, the waist band portions of denim pants as illustrated in FIG. 3. FIG. 3 shows the tip end portion of the fight side of the waist band portions of the denim pants. At the tip ends of the waist band portions, a plurality of workpieces are sewn together, and further the tip end portions thereof are folded inside to be subjected to sewing. As a result, the portion to be sewn is uneven in thickness as a whole since the workpieces A sewn together and folded back are concentrated in a narrow area therein.

The cross section of the workpiece A cut along the stitches I—I as shown in FIG. 3 comprises a two-layered thin portion D composed of a surface cloth A1 and a back cloth A2, and a four-layered thick portion B composed of the surface cloth A1, the backing cloth A1*b* thereof formed by folding back the surface cloth A1, the back cloth A2 and the backing cloth A2*b* thereof formed by folding back the back cloth A2 as illustrated in FIG. 4.

The cross section of the workpiece A cut along the stitches II—II comprises the four-layered thick portion B composed of the surface cloth A1, the backing cloth A1*b* thereof formed by folding back the surface cloth A1, the back cloth A2 and the backing cloth A2*b* thereof formed by folding back the back cloth A2, a six-layered thick portion F which is connected to the thick portion B and is composed of the thick portion B and adding thereto, a main cloth A10 and the backing cloth A11 thereof formed by folding back the main cloth A10, and a ten-layered thick portion C which is connected to the thick portion F and is substantially as thick as the other thick portion C, described later, as illustrated in FIG. 5.

The cross section of the workpiece A cut along the stitches III—III comprises a five-layered thin portion E composed of the surface cloth A1, the surface-cloth back side A1*b* thereof formed by folding back the surface cloth A1, the back cloth A2, the back-cloth back side A2*b* thereof formed by folding back the back cloth A2 and the main cloth A10, and a ten-layered thick portion C which is connected to the thin portion E and is composed of the thin portion E and adding thereto, the cloth A1*bb* formed by folding inside the surface-cloth back side A1*b*, the cloth A1*ab* formed by folding inside the surface-cloth surface side A1*a*, a backing cloth A11 formed by bolding back the main cloth A10, a cloth A2*ab* formed by folding back the back-cloth surface side A2*a* and a cloth A2*bb* formed by folding inside the back-cloth back side A2*b* as illustrated in FIG. 6. It means that the thin portions D and E are thinner than the thick portions B and C which are connected to the former in front thereof respectively.

When these stitches I—I, II—II and III—III are formed, the tip end presser portions 15*b* and 16*b* of the central clamp feet 15 and 16 and the side presser portions 17*b* and 18*b* of the side clamp feet 17 and 18 are arranged along a line inside the cut-out portion 14*c* of the feeder plate 14*b* as illustrated in FIG. 3. At that time, the tip ends of the tip end presser portions 15*b* and 16*b* and the side portions of the side presser portions 17*b* and 18*b* press the workpiece at portions closely inside the stitches II—II and the tip end portions of the stitches I—I and III—III, and those closely inside the rear end portions of the stitches I—I and III—III respectively. At this state the presser cylinder unit 2 is contracted to respectively lower the clamp feet 15, 16, 17 and 18 of the presser 3 by way of a link mechanism, not shown. At the time of sewing, the needle 7 passes the cut-out portion 14*c* of the feeder plate 14*b*.

The tip end presser portions 15*b* and 16*b* substantially conform in longitudinal length to the lengths $L_1$ and $L_2$ between the rear end portions of the thick portions B and C of the workpiece A and the stitches II—II respectively, while the side presser portions 17*b* and 18*b* of the side clamp feet 17 and 18 substantially conform in longitudinal length to the lengths $L_4$ and $L_5$ which are obtained by subtracting those of the thick portions B and C of the workpiece A along the stitches I—I and III—III from those of the stitches I—I and III—III respectively. The tip end presser portions 15*b* and 16*b* effectively press down the thick portions B and C respectively, while the side presser portions 17*b* and 18*b* effectively press down the thin portions D and E respectively. In this way, the U-shaped sewing is performed with high-quality at the tip ends of the waist band portions of denim pants, where the workpiece A pressed down by the presser 3 largely varies in thickness.

When the tip end presser portions 15*b* and 16*b* and side presser portions 17*b* and 18*b* press down the workpiece A, the elastic supporting bodies 54, 55, 56 and 57 of the pressing mechanism 60 operate individually and in liaison with one another to press down the workpiece A with certainty without forming a gap thereon irrespective of the variation of thickness of the portion to be sewn. That is, when the U-shaped portion at the right end of the waist band is sewn, the tip end presser portion 16*b* of the left central clamp foot 16 acts on the thick portion C where the largest number of cloths are put on one another, and to the contrary when the U-shaped portion at the left end of the waist band is sewn, the tip end presser portion 15*b* of the right central clamp foot 15 acts on the thick portion C where the largest number of cloths are put on one another, the tip end presser portions 15*b* and 16*b* are individually operated by the elastic supporting bodies 54 and 55 respectively. Moreover, the two side clamp feet 17 and 18 respectively arranged at the outer sides of the central clamp feet 15 and 16 adjacent thereto separately function independently from the latter. Accordingly, the U-shape sewing can be performed more easily at the tip end of the waist band portion without adjusting the pressing mechanism 60 irrespective of the longitudinal and lateral variation of thickness of the workpiece A. After the stitches I—I, II—II and III—III are successively formed in given directions on a workpiece A, the stitches III—III, II—II and I—I are continuously formed in a reverse order on next workpiece A.

Although the pressing mechanism 60 is formed of the elastic supporting bodies 54, 55, 56 and 57 each made of coil spring in the above embodiment, it is possible to replace the elastic supporting bodies 54, 55, 56 and 57 with pneumatic cylinder units, flat springs or the like.

As understood from the above description, the following effect can be obtained according to the present invention.

Since four clamp feet can separately fit the shape and thickness of the portion of a workpiece to be sewn, it is possible to perform the U-shape sewing continuously and easily to the tip ends of the waist band portions of pants irrespective of the longitudinal and lateral variation of thickness of the workpiece, and moreover without additional adjustment of the presser mechanism. That is, the longitudinal and lateral variation of thickness of the workpiece at the tip end of the waist band portion is applied is absorbed by separate clamp feet each dedicated to its purpose and the presser mechanism for elastically hold each clamp foot at the time of the U-shape sewing so as to easily perform sewing with stable quality. As a result, discontinuous stitches and needle breakage are not generated to eliminate the operation of sewing anew, exchanging a needle or the like, so that it is possible to improve efficiency and perform sewing with high quality.

What is claimed is:

1. A presser unit for a bar tacking sewing machine used for sewing U shaped tip ends on the waist band portions of pants, comprising:

two central clamp feet and two side clamp feet cooperating to conform to a U-shaped sewing operation; and a pressing mechanism for elastically pressing each of said central and side clamp feet toward a workpiece with a given pressure so as to elastically press portions of said workpiece of varying thickness with each of said clamp feet, said central clamp feet having respective tip ends used to press thicker portions of said workpiece and said side clamp feet being positioned adjacent to said central clamp feet for pressing thinner portions, relative to said thick portions, of said workpiece.

2. A presser unit for a bar tacking sewing machine as defined by claim 1, further comprising:

a supporting arch member having opposed sides;

two pairs of elastic supporting bodies, one pair being mounted on each of said opposed sides of said supporting arch member;

four arm members, each having a central portion, a tip end, and a rear portion, each of said central portions being pivotally supported on said supporting arch member and each of said rear portions being mounted on a respective one of said elastic supporting bodies; and each of said side and central clamp feet being attached to a respective one of said tip ends of said arm members.

3. A presser unit for a bar tacking sewing machine as defined by claim 2, further comprising:

a clamp foot provided above said rear portions of said arm members to press down said arm members when said presser foot lowers.

* * * * *

UNITED STATES PATENT AND TRADEMARK OFFICE

CERTIFICATE OF CORRECTION

PATENT NO. : 5,715,766

DATED : February 10, 1998

INVENTOR(S) : Takao Numanoi

It is certified that error appears in the above-indentified patent and that said Letters Patent is hereby corrected as shown below:

TITLE PAGE

Assignee: "The Singer Company N.V., Curaco, Netherlands"

Should be

Assignee: --The Singer Company N.V., Curaco, Netherlands Antilles--

Signed and Sealed this

Seventh Day of July, 1998

Bruce Lehman

*Attest:*

BRUCE LEHMAN

*Attesting Officer*

*Commissioner of Patents and Trademarks*